US005818484A

United States Patent [19]

Lee et al.

[11] Patent Number: 5,818,484

[45] Date of Patent: Oct. 6, 1998

[54] PRINTING FLUID SUPPLY SYSTEM HAVING AN APPARATUS FOR MAINTAINING CONSTANT STATIC PRESSURE

[75] Inventors: Charles C. Lee, Little Canada; Bruce H. Koehler, Maplewood; Jeffrey C. Pederson, Minneapolis, all of Minn.

[73] Assignee: Minnesota Mining and Manufacturing Company, St. Paul, Minn.

[21] Appl. No.: 527,604

[22] Filed: Sep. 13, 1995

[51] Int. Cl.[6] ..... B41J 2/175

[52] U.S. Cl. ..... 347/86; 347/85

[58] Field of Search ..... 347/85, 86, 87

[56] References Cited

U.S. PATENT DOCUMENTS

| | | | |
|---|---|---|---|
| 3,708,798 | 1/1973 | Hildenbrand et al. | 346/140 |
| 4,074,284 | 2/1978 | Dexter et al. | 346/140 |
| 4,342,042 | 7/1982 | Cruz-Uribe et al. | 346/140 |
| 4,831,389 | 5/1989 | Chan | 346/140 |
| 4,885,595 | 12/1989 | Kaplinsky et al. | 346/140 |
| 4,929,963 | 5/1990 | Balazar | 346/1.1 |
| 4,999,652 | 3/1991 | Chan | 346/140 |
| 5,367,328 | 11/1994 | Erickson | 347/7 |
| 5,369,429 | 11/1994 | Erickson | 347/7 |

FOREIGN PATENT DOCUMENTS

| | | | |
|---|---|---|---|
| 0 237 787 A3 | 9/1987 | European Pat. Off. | B41J 3/04 |
| U-9300133 | 6/1993 | Germany | B41J 2/175 |
| 60-248355 | 12/1985 | Japan | B41J 3/04 |
| 62-232760 | 10/1987 | Japan | B41J 3/04 |
| 4-208469 | 7/1992 | Japan | B41J 2/175 |

OTHER PUBLICATIONS

Product manual, "Ink Refill System III for Novajet III," Polyvision Systemtechnik GMBH, Germany, 19 pages. (Sep. 1995).

"ENCAD Demos 50–Inch Device, Offers Built–In Ink Reservoirs," *The Hard Copy Observer,* p. 55 (Jun. 1995), 1 page.

"Colossal Bulk Ink Installation Instructions for NovaJet I and NovaJet II printers", Colossal Graphics Incorporated, Palo Alto, CA (Aug. 4, 1994), v1.8.1, p. 1–11.

"Colossal Bulk Ink Installation Instructions for Hewlett Packard DesignJet 650C printers (36" model)", Colossal Graphics Incorporated, Palo Alto, CA (Oct. 5, 1994), v1.0, pp. 1–8.

News release, "Colossal Graphics, Inc., introduced Bulk Ink™ systems for Encad NovaJet II and Hewlett Packard DesignJet 650C printers," Colossal Graphics Incorporated, Palo Alto, CA (Sep. 14, 1994), 2 pages.

R.L. Jones, "High–capacity Ink Delivery Systems, The Benefits and Pitfalls," 1995 DPI Conference, Orlando, FL, Colossal Graphics, Inc., Palo Alto, CA, (Apr. 19–22, 1995), 17 pages.

Patent Abstracts Of Japan, vol.10, No. 118 (M–475) [2175], 2 May 1986 (abstract for Japanese Patent No. 60–248355).

Patent Abstracts Of Japan, vol. 10, No. 549 (M–1338), 18 Nov. 1992 (abstract for Japanese Patent No. 4–208469).

*Primary Examiner*—Jeffrey L. Sterrett

*Attorney, Agent, or Firm*—Gary L. Griswold; Walter N. Kirn; John H. Hornickel

[57] ABSTRACT

The present invention provides methods and apparatus for maintaining substantially constant vertical distance between the free surface of a printing fluid in a fluid supply and printing mechanism by supporting a container against the force of gravity with a resilient member.

36 Claims, 5 Drawing Sheets

PRINTING FLUID SUPPLY SYSTEM HAVING AN APPARATUS FOR MAINTAINING CONSTANT STATIC PRESSURE

FIELD OF THE INVENTION

The present invention relates to the field of methods and apparatus for maintaining constant static pressure between a fluid supply and an outlet for the fluid. More particularly, the present invention relates to methods and apparatus for maintaining a substantially constant vertical distance between the free surface of a printing fluid supply and a printing mechanism for applying the printing fluid to a medium.

BACKGROUND

Printers and plotters for applying ink and other printing fluids are well known. Such devices typically include a supply of printing fluid and a printing mechanism In a typical printer or plotter, printing fluid is routed to the printing mechanism using tubing to supply the required printing fluid to the printing mechanism.

In one particular type of printer, ie., an inkjet printer, an ink supply is connected to a print head to supply ink to the print head. It is preferred that the ink supply be under slightly negative pressure at the print head to avoid weeping and leakage of ink which can reduce the quality of printing and, potentially, also cause clogging of the print head.

One of the problems associated with inkjet ink supplies is the limited ink capacity of such systems. This problem is particularly acute in larger printers and plotters which use ink at a much faster rate than office or letter size inkjet printers.

Various approaches have been proposed to address the problem of limited ink supply. One solution is to supply ink in a sealed bag containing a fixed supply of ink. The bag collapses as ink is removed from it, which avoids creating a relatively high negative pressure in the system that could prevent ink from flowing to the print heads.

One problem, with this approach is that the bags are not refillable because they must be sealed to function properly. As a result, the system is more expensive to operate and results in larger amounts of waste. In addition, the pressure head between the ink supply and the print head is not constant because the level of the ink in the bag relative to the print head varies as the ink is removed from the bag. That variation results in changes in the flow of ink to the printing head.

Another approach is to provide a refillable reservoir of ink which is replenished as the ink flows to the print head. The ink is replenished using a pump and a level sensing system to control the pumping action in response to changes in the level of ink in the reservoir.

Problems with this approach include the expense and complexity of providing both pumping and level sensing equipment. In addition, many of these systems typically allow variations in the ink level as the fluid level cycles between a low level which turns the pump on and a high level which turns the pump off. As the ink level moves between those levels, the pressure head in the system changes. Those changes can cause variations in the flow of ink to the print head which, in turn, can alter the print quality by, for example, causing color shifting through variations in print density. Furthermore, adding such equipment provides additional sources of problems requiring maintenance during operation of the printer or plotter.

A variation of the last approach is to refill a primary reservoir connected to the print head using a one-way float valve suspended below a secondary reservoir. In that system, as ink is supplied to the print head, the fluid level in the primary reservoir falls, opening the valve and allowing ink from the secondary reservoir into the primary reservoir. As the ink from the secondary reservoir flows into the primary reservoir, the fluid level rises, closing the valve and maintaining the ink level.

There are numerous problems with this approach including maintaining proper operation of the float valve. Typically, ink collects on the valve, causing it to remain open. As a result, the primary reservoir tends to completely fill with ink from the secondary reservoir. That causes the pressure head in the system to vary as the level of ink in the secondary reservoir fills in response to consumption of ink or increases in response to refilling of the secondary reservoir.

SUMMARY OF THE INVENTION

The present invention provides methods and apparatus for maintaining substantially constant vertical distance between the free surface of a printing fluid in a fluid supply and printing mechanism in a printing system.

In one aspect, the present invention comprises a resilient member supporting a container that is open to ambient pressure against the force of gravity such that the distance between the free surface of ink in the container and the printing mechanism in a printer remains substantially constant as ink is consumed during printing. The basic principle underlying operation of the present invention is Hooke's law.

One advantage of the present invention is that it provides a simple, robust design that is inexpensive to implement and maintain.

Another advantage of the present invention is that it can be easily adjusted to adapt to inks having different densities or to resilient members having variable spring constants. As a result, the system can maintain a substantially constant vertical distance between the free surface of the printing fluid supply and the printing mechanism for a variety of different printing fluids.

Another advantage is that the container is open to ambient pressure which also allows for refilling of the container because the user is not concerned with retaining a sealed container of printing fluid.

Yet another advantage of the present invention is that it can provide damping of any movement of the ink container due to loading the system, movement of the printer, etc. The damping further assists in maintaining the pressure head in the system. This may be particularly useful in systems subject to vibration, such as inkjet printers in which the print heads are accelerated and decelerated rapidly during printing, which can vibrate the printer and any attached fluid supply.

These and other features and advantages of the present invention will be apparent upon reading of the following detailed description.

DETAILED DESCRIPTION OF ILLUSTRATIVE EMBODIMENTS

The present invention provides methods and apparatus for maintaining substantially constant vertical distance between a printing fluid supply and an outlet for the printing fluid. Typically, the outlet will comprise some printing mechanism, such as an inkjet print head, spray jet print head, toner drum, etc.

The discussion below will focus on inkjet printing systems, but it should be understood that the present invention is applicable to any printing system in which the printing is accomplished using a liquid printing material that is transported to the printing mechanism as a fluid for printing onto a medium by maintaining a constant vertical distance between the free surface of the fluid and the printing mechanism, the variation in flow of the printing fluid from the fluid supply to the printing mechanism due to changes in static suction lift between the two can be reduced. As a result, variations in print quality can be decreased.

Furthermore, although ink is described for use with the inkjet printing systems below, it will be understood that any liquid printing material could be used in conjunction with the present invention. Examples of liquid printing materials include, but are not limited to inks and liquid toners.

In addition, typical inkjet systems rely on slight negative pressure between the fluid supply and the print head to prevent weeping and leakage. It should be understood, however, that the present invention could be used in any printing system, whether positive or negative pressure is provided between the fluid supply and the printing mechanism.

Turning now to one specific application of the present invention, inkjet printing systems typically rely on the vacuum developed inside the print head as ink is consumed during printing. The vacuum required to pull ink from the fluid supply depends on the vertical distance between the free surface of the ink and the inkjet print head. If that vertical distance changes during printing, the printing process can be adversely affected because the pressure difference between the print head and ink also changes with the change in distance between the free surface of the ink and the print head.

Figure 1:
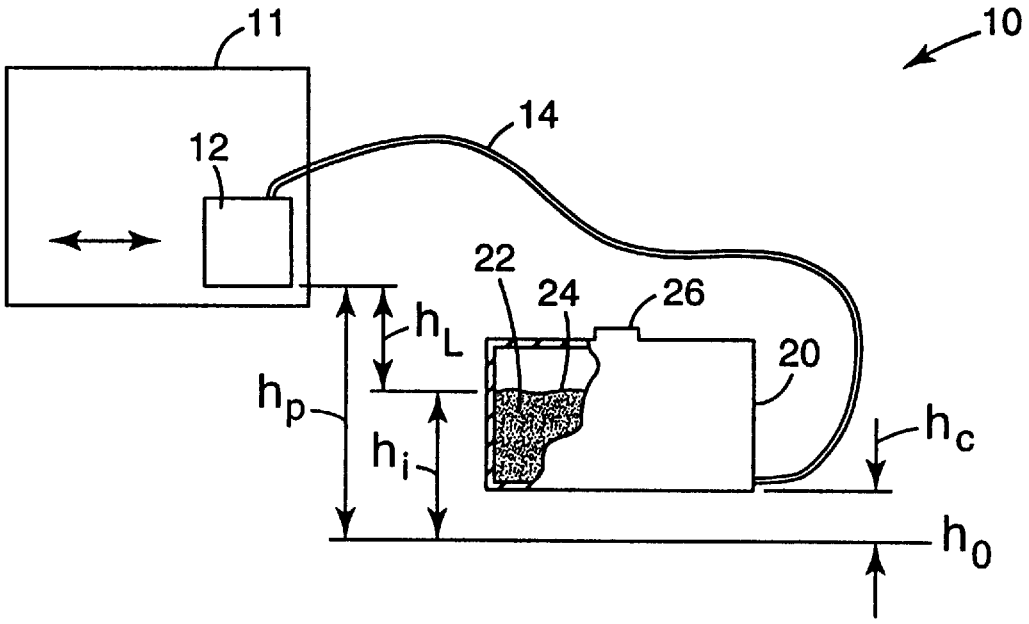
FIG. 1 is a schematic diagram of one printing system including a printing fluid supply system according to the present invention.

Referring now to FIG. 1, an illustrative embodiment of one schematic inkjet supply system 10 according to the present invention is depicted including an inkjet printer or plotter 11 and corresponding print head 12, fluid line 14 and ink supply container 20. Also depicted in FIG. 1 is a fixed datum plane, $h_0$, which serves as a reference point for describing operation of the system 10.

Container 20 holds a supply of ink 22 having a free surface 24 located a distance $h_i$ above the datum $h_0$. The bottom of the container 20 is located a distance $h_c$ above the datum $h_0$. The container 20 is preferably open to ambient pressure through an opening such as 26 depicted in FIG. 1. Opening 26 also preferably allows for refilling of the container 20 as ink 22 is consumed during printing.

Fluid line 14 is provided to supply ink 22 from container 20 to the print head 12. Typically, it is preferred that fluid line 14 comprise a relatively small diameter tubing to reduce the amount of ink in the fluid line 14. In one illustrative embodiment, the fluid line 14 has an inside diameter of about 3.175 mm Those skilled in the art will, however, be able to select tubing with the appropriate inside diameter for their printing systems using known methods.

As shown in FIG. 1, it is preferred to draw ink 22 out of container 20 at a low point to allow for proper operation of the system down to the lowest levels of ink 22 in the container 20. Higher placement of the outlet is possible, but may require more frequent refilling of container 20. Furthermore, although the outlet is shown as located on the side of the container 20, it will be understood that the outlet could be provided as a stand pipe with its opening located near the bottom of the container 20 (see, e.g., reference number 518 in FIG. 6).

The print head 12 is located a fixed distance of $h_p$ above the datum $h_0$ and is typically mounted in a printer or plotter for movement in a horizontal direction across a substrate such as paper or film. As a result, although the print head 12 moves to accomplish a printing operation, its distance $h_p$ above the datum $h_0$ remains fixed. The print head 12 is located a distance of $h_L$ above the free surface 24 of the ink 22.

One important feature of the present invention is that it provides the ability to maintain the distance between the print head 12 and free surface 24 of the ink 22 in container 20, i.e., $h_L$, substantially constant by supporting the container 20 in a manner such that as ink 22 is removed from container 20, the container 20 itself is moved with respect to both the print head 12 and the datum $h_0$. As a result, the static pressure head between the ink 22 and the print head 12 (determined by the distance $h_L$) remains substantially constant throughout the printing process, both when ink 22 is being consumed and when ink 22 is being added to the container 20 (or if a fill container 20 replaces a nearly empty container).

Various mechanisms can be used to maintain a substantially constant vertical distance between the ink 22 and the print head 12. One illustrative embodiment is depicted schematically in FIG. 2. As shown there, the container 120 is supported on a plate 128 which is operatively attached to a coil spring 130. Coil spring 130 is mounted in a housing 132.

Housing 132 is mounted at a fixed height with respect to a print head (not shown). Alternatively, housing 132 could be eliminated and spring 130 attached to any structure, provided the points of attachment to spring 130 are maintained at a constant height relative to the print head.

As ink 122 is added or removed from container 120, the force on spring 130 changes, resulting in movement of the container 120. As ink 122 is removed, the container 120 will move upward and, conversely, as ink 122 is added the container 120 will move downward.

The ability to maintain the free surface 124 of the ink 122 within the container 120 at a substantially constant level with respect to fixed datum is provided by choosing a spring 130 with the correct spring constant such that the decrease in depth of the ink 122 in the container 120 is substantially equal to the rise in height of the container 120 relative to the print head, where the movement of the container 120 is caused by the resilient member 130 and is governed substantially by Hooke's law, which is represented by the equation:

$$F=kx$$

where F is the force exerted on the spring, k is the spring constant of the spring, and x is the displacement caused by the force F. In connection with the present invention the force F will typically be a function of gravity operating on the container 120 and ink 122.

Actual choice of the spring 130 with the correct spring constant k will be governed by the cross-sectional area of the container 120 and the density of the ink in the container 120 which, together, determine the weight of ink per unit of depth in the container 120. The spring constant k should be chosen to match that value as closely as possible.

Although the discussions here center on the use of coil or torsion springs, it will be understood that the methods and apparatus according to the present invention could be implemented with any resilient member or members. Alternative examples could include leaf springs, elastomeric materials or any material/structure that acts according to Hooke's law.

Figure 2:
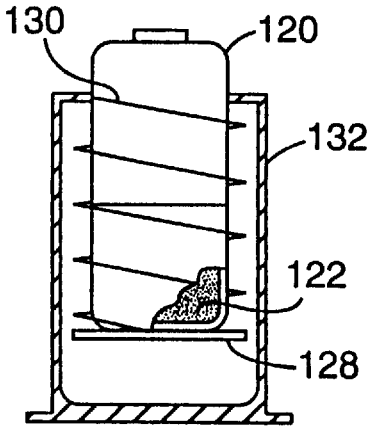
FIG. 2 is a schematic diagram of one illustrative embodiment of a printing fluid container support system according to the present invention.

Although only one spring 130 is depicted in FIG. 2, it will be understood that a plurality of springs could be attached to plate 128 to support container 120. In such an embodiment, the spring constants of each spring should be added to determine their combined spring constant of the entire system.

Furthermore, although the spring 130 is shown as operating in tension, it will be understood that it could alternatively operate in compression as well.

Figure 3:
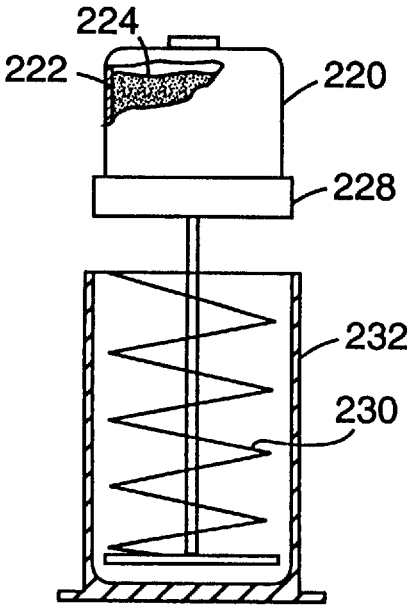
FIG. 3 is a schematic diagram of another illustrative embodiment of a printing fluid container support system according to the present invention.

FIG. 3 depicts another illustrative system used to maintain a substantially constant vertical distance between the free surface 224 of ink 222 in a container 220 and a print head in an inkjet printer (not shown). The container 220 is supported on a plate 228 which is operatively attached to a coil spring 230. Coil spring 230 is mounted in a housing 232.

Housing 232 is mounted at a fixed height with respect to a print head (not shown). Alternatively, housing 232 could be eliminated and spring 230 attached to any structure, provided the points of attachment to spring 230 are maintained at a constant height relative to the print head.

As with the system depicted in FIG. 2 and described above, the movement of container 220 is governed by Hooke's law. When ink is added or removed from container 220, the force on spring 230 changes, resulting in movement of the container 220. As ink is removed, the container 220 will move upward and, conversely, as ink is added the container 220 will move downward. Proper choice of spring 230 with the correct spring constant k will result in a substantially constant vertical distance between the free surface 224 of the ink 222 in container 220 and the print head (not shown).

Furthermore, although only one spring 230 is depicted in FIG. 3, it will be understood that a plurality of springs could be attached to plate 228 to support container 220. In such an embodiment, the spring constants of each spring should be added to determine the combined spring constant of the system.

In addition, although the spring 230 is shown as operating in tension, it will be understood that it could alternatively operate in compression as well.

Figure 4:
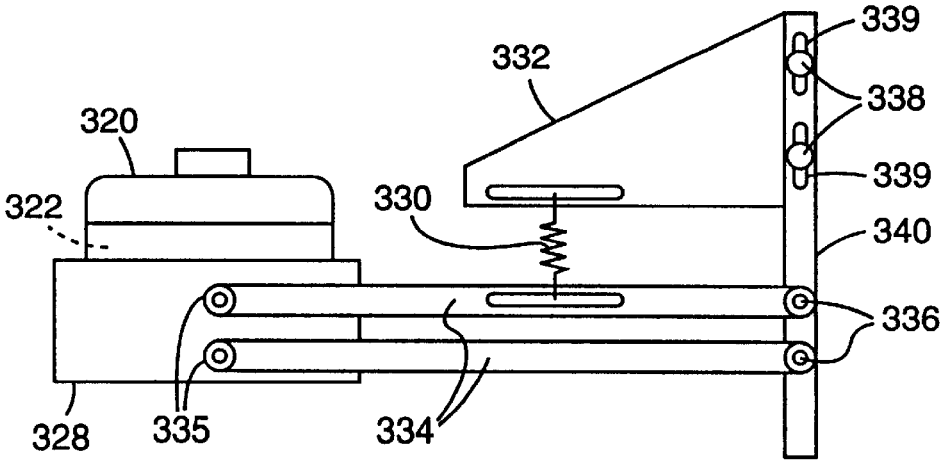
FIG. 4 is a schematic diagram of another illustrative embodiment of a printing fluid container support system according to the present invention.

Another alternate illustrative embodiment of a system according to the present invention is depicted in FIG. 4 which includes ink 322 in a container 320. The container 320 is supported by a pair of parallel arms 334 which pivot about fixed points 336 on support member 340 and about points 335 on housing 328. At least one of the arms 334 is connected to a coil spring 330 which is supported from member 332. Member 332 is movable with respect to fixed rotation points 336, using fasteners 338 mounted in slots 339 to allow for adjustment of the height of free surface 324 of fluid 322 in container 320.

It will be understood that parallel arms 334 could be provided as a single arm if container 320 were supported such that its center of gravity remained below rotation point 335 at all times. As shown with parallel arms 334, however, container 320 will remain level at all times, irrespective of the location of its center of gravity.

As with the systems depicted in FIGS. 2 and 3, the movement of container 320 is governed by Hooke's law. When ink is added or removed from container 320, the force on spring 330 changes, resulting in movement of the container 320. As ink is removed, the container 320 will move upward and, conversely, as ink is added the container 320 will move downward. Proper choice of spring 330 with the correct spring constant k will result in a substantially constant vertical difference between the free surface 324 of ink 322 and the print head.

Furthermore, although only one spring 330 is depicted in FIG. 4, it will be understood that a plurality of springs could be attached to arm 334 to support container 320. In such an embodiment, the spring constants of each spring should be added to determine the combined spring constant of the system.

In addition, although the spring 330 is shown as operating in tension, it will be understood that it could alternatively operate in compression as well.

In yet another feature of the embodiment depicted in FIG. 4, the movement of spring 330 horizontally, i.e., towards or away from pivot points 336 can also result in an effective change in force which must be exerted by the spring to support container 320. That is so because arm 334 acts as a lever, providing a mechanical advantage to the force exerted by spring 330 as its distance from the pivot point 336 increases. Compensating for such variations will be well within the skill of those in the art and will not be explained further herein.

For the same reasons, it should be understood that the range of motion of container 320 is somewhat limited before the change in angles between the spring 330 and arm 334 causes an effective difference in the force exerted on spring 330. In many cases, however, the vertical distance traveled by container 320 will be sufficiently small that the variation will not be noticeable.

Figure 5:
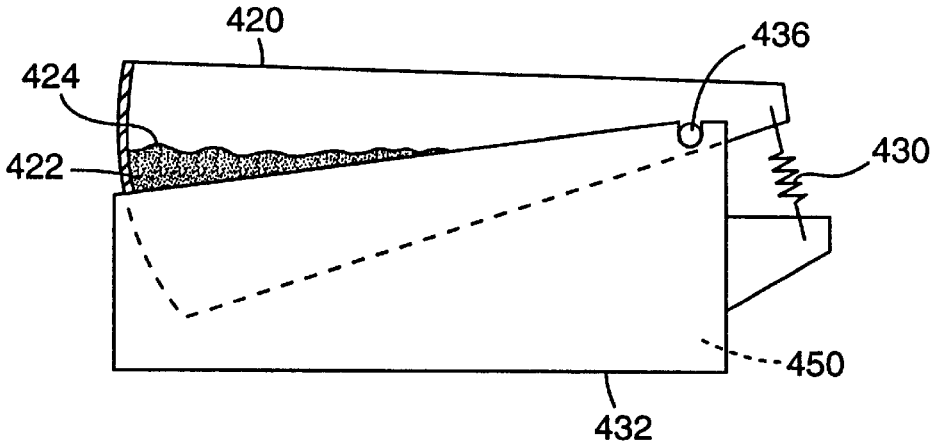
FIG. 5 is a schematic diagram of another illustrative embodiment of a printing fluid container support system according to the present invention.

Still another alternate illustrative embodiment of a system according to the present invention is depicted in FIG. 5. As shown, the container 420 itself is attached to rotate about a pivot point 436. In this embodiment, a coil spring 430 is attached to the container 420 to support it and the ink 422 inside the container such that the height of the free surface 424 of the ink 422 with respect to a print head remains substantially constant as ink 422 is removed from or added to container 420.

It is relatively important to ensure that the surface area of the free surface of fluid 422 remain substantially constant as the ink is removed from or added to container 420 because of the linear nature of Hooke's law and of spring constants in general. To assist that, it is preferred that the free surface 424 be substantially equal to the pivot point 436.

The use of container 420 in housing 432 also provides an additional advantage in that movement of the container 420 is damped by the volume of air in space 450 in housing 432. To provide the damping benefits, the fit between container 420 and housing 432 should be relatively tight to limit air flow into and out of volume 450.

Figure 5A:
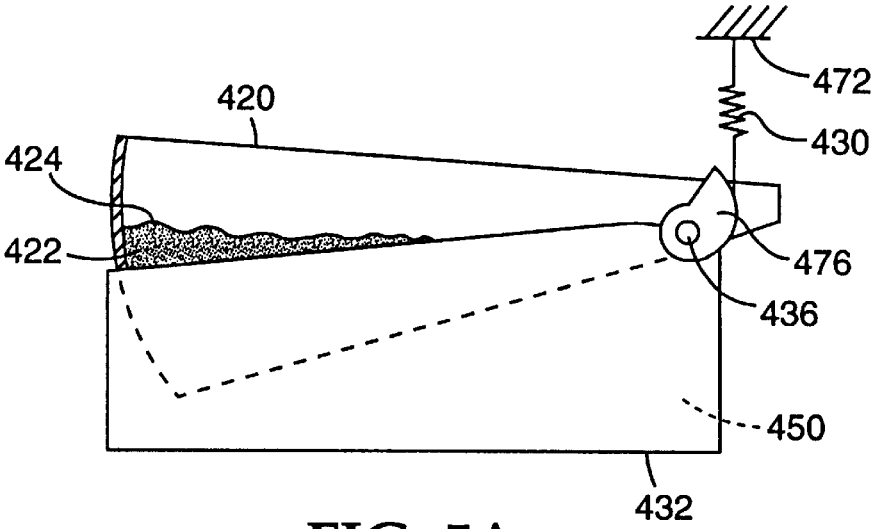
FIG. 5A is a schematic diagram of an alternate spring mechanism including a cam member for use with the container of FIG. 5.

A further option is to consider and adjust for the changing torque caused as the container 420 rotates from a horizontal to a vertical orientation. One such method of adjusting for the change is depicted in FIG. 5A in which spring 430 is shown as attached to a cam 476 which rotates about point 436. By using a cam 476, an adjustment can be made for the change in torque caused by changes in the amount of ink 422 in container 420.

A container 420 with a substantially pie-shaped cross-section is helpful, although it may be advantageous to provide other cross-sections as well, such as a modified pie-shape in which the upper radial distance is greater than the lower radial distance. Other variations are also possible based on the weight distribution of the container 420 itself.

Figure 6:
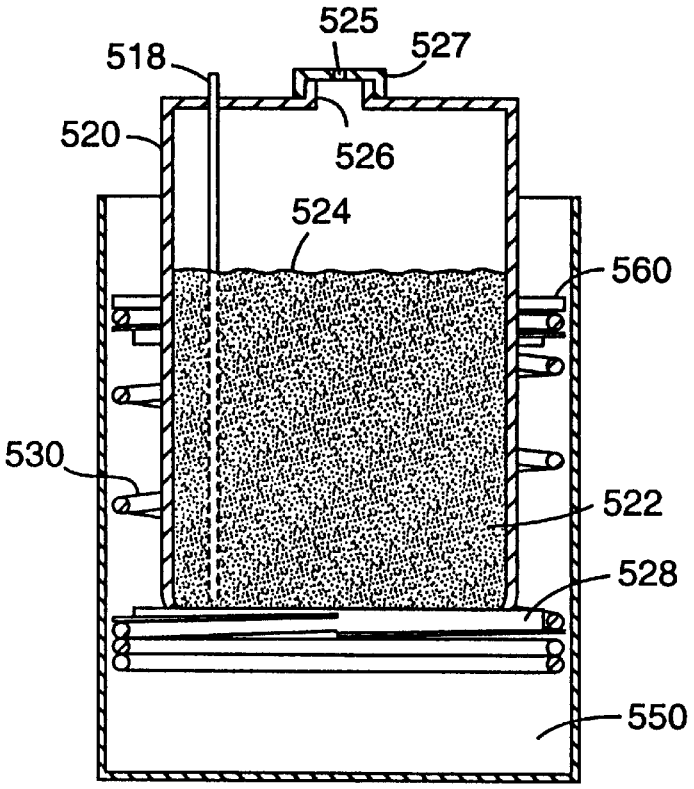
FIG. 6 is a cross-sectional schematic diagram of one illustrative embodiment of a printing fluid container and support system according to FIG. 2.

Turning now to FIG. 6, an illustrative embodiment of one container support system similar to that discussed with respect to FIG. 2 is depicted in greater detail including a container 520 holding ink 522 having a free surface 524. The container 520 includes an opening 526 and a cap 527. Cap 527 includes a smaller opening 525 which allows the pressure above the ink 522 to equalize with the ambient pressure outside of container 520 while, at the same time, preventing excessive evaporation of the ink 522. Wider opening 526 provides the ability to refill and/or clean container 520.

Another use for smaller opening 525, is to provide a port useful for priming a printing system by pressurizing the container 520 to force ink to the print head. Such priming is well known in the art and will not be described further herein.

Also included in container 520 is a tube 518 which preferably extends to near the bottom of the container 520. This tube is adapted for connection to the fluid supply line 14 discussed with respect to system 10 depicted in FIG. 1. By extending the tube to near the bottom of the container 520, the container can be nearly empty before replacement or refilling is required.

The container 520 is supported within a housing 532 which also contains a spring 530 and plate 528. Plate 528 is threaded into the coils of spring such that its position with respect to the coils of the spring can be maintained substantially constant. One illustrative embodiment of a plate 528 will be described in more detail below with respect to FIGS. 8–10.

The upper end of spring 530 is fixedly attached to the housing 532 using a support ring 560. Ring 560 supports spring 530 by capturing the uppermost coil and retaining is within a channel formed about the circumference. One illustrative embodiment of a ring 560 will be further described below with respect to FIGS. 11–13.

Figure 7:
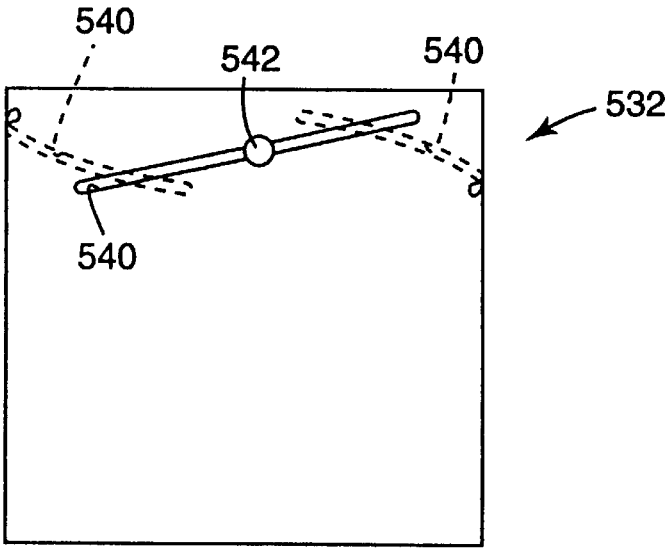
FIG. 7 is a side view of a housing for use with a printing fluid supply container support system according to FIG. 6.

Turning briefly to FIG. 7, the ring 560 is connected to housing 532 using a plurality of connectors 542 located in helical slots 540 formed in housing 532. By connecting ring 560 to housing 532 using helical slots 540, the height of the upper end of spring 530 can be adjusted by loosening connectors 542 and rotating ring 560 and attached spring 530 relative to housing 540. After spring 530 is located at the desired height, the connectors 540 can be retightened to maintain the upper end of the spring 530 at the desired height. In the illustrative embodiment pictured in FIG. 7, three slots 540 are provided, with their midpoints located at 120° intervals about the circumference of housing 532.

Moving the height of the upper end of spring 530 is useful to adjust the height of free surface 524 of the ink 522 in container 520 to compensate for variations in the weight of the container 520 itself, inks 522 having different densities, or springs 530 with varying spring constants. After the height of the upper end of spring 530 is set, however, it should not need adjustment until a new container 520 or a different ink 522 is used.

The plate 528 used to support container 520 in housing 532 also provides a means of adjusting another feature, i.e., the spring constant acting on the container 520. By rotating the plate 528, which is threaded into the coils of spring 530, the number of coils acting to support plate 528 can be adjusted, thereby varying the spring constant. This feature is a characteristic of all coil springs, i.e., the spring constant is inversely related to the number of coils acting to provide the force. As a result, if a smaller spring constant is desired, the plate 528 can be threaded downward to increase the number of coils of spring 530 acting on the plate 528. Conversely, if a larger spring constant is desired, the plate 528 can be threaded upward to reduce the number of coils of spring 530 acting on the plate 528.

In the embodiment depicted in FIG. 6, it is preferred that the housing 532 and container 520 be constructed of a transparent or semi-transparent materials to allow for visual monitoring of the ink level in the container 520. Visual monitoring of the ink level is also helpful in setting the initial height of the free surface 524 of the ink 522.

Another feature of the housing 532 and container 520 combination depicted in FIG. 6 is that movement of the plate 528 and container 520 relative to the print head can be damped to further enhance the system's ability to maintain constant vertical distance between the free surface of the ink and the print head. In one version, the damping can be accomplished by providing a relatively tight fit between the perimeter of the plate 528 and the inner surface of the housing 532 along with sealing the bottom of the housing 532. As a result, the volume of air in the space 550 between the plate 528 and the bottom of the housing 532 will act as a damper to movement of the plate 528. Alternatively, a seal could be provided around the outside of the bottle itself at the top of the housing 532. Where it is not practical to seal the bottom of the housing, seals could be provided around the container 520 at the top of the housing 532 and around the plate 528 to define a relatively fixed volume of air surrounding the container 520 within housing 532.

In some instances, it may be sufficient to rely on friction between container 520 and housing 532 and/or support plate 528 and housing 532. Other means for damping will also be known to those skilled in the art.

In any embodiment, damping can reduce the time needed for the container 520 to come to rest after a new container is placed in the housing 532 or if the printer is moved in manner which also moves the container 520 and causes spring 530 to compress or extend. Also, the damping can prevent changes in the vertical distance between the free surface 524 of the ink 522 and the print head due to vibration of the printer as the print head is accelerated and decelerated during printing.

Figure 8:
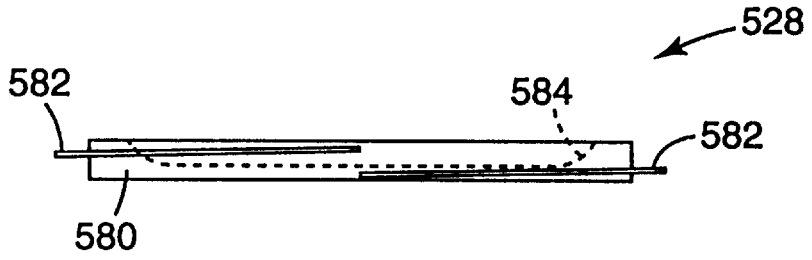
FIG. 8 is a side view of one illustrative embodiment of a support plate for use with a printing fluid supply container support system according to FIG. 6.
Figure 9:
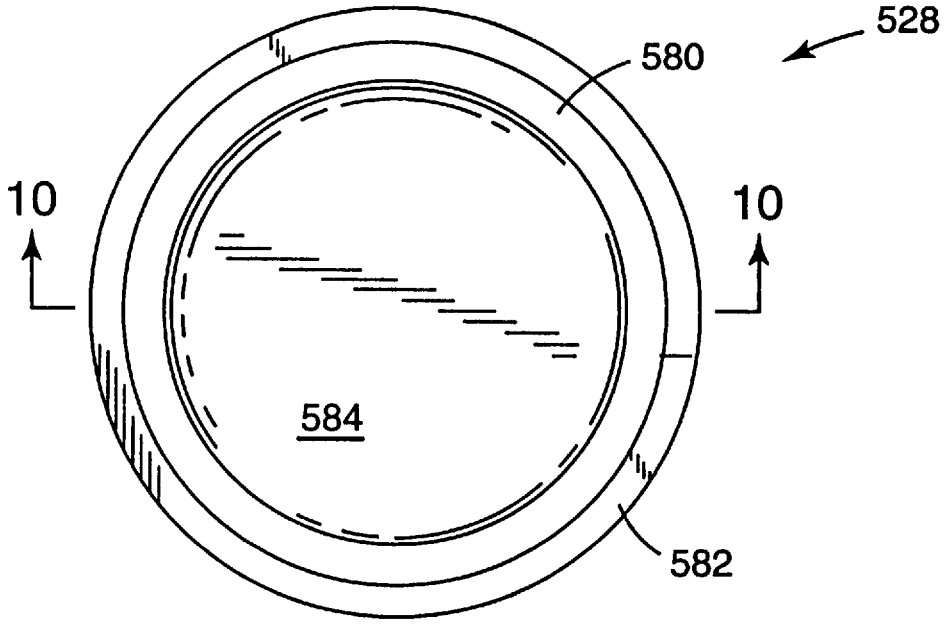
FIG. 9 is a top view of the plate of FIG. 8.
Figure 10:
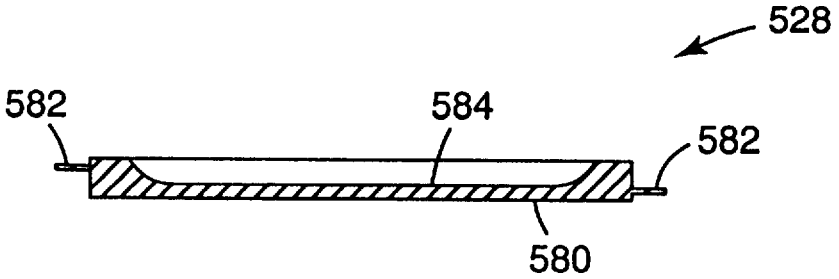
FIG. 10 is a cross-sectional view of the plate of FIGS. 8 & 9, taken along line A—A.

Turning now to FIGS. 8–10 which depict one illustrative enbodiment of the support plate 528 in greater detail. The support plate 528 includes a central portion 580 that has a concave upper surface to receive one container (not shown) in a nesting relationship. Flange 582 extends outward from the periphery of central portion 580 and is preferably helical to allow for easy threading of plate 528 into a spring (not shown). It should be understood that the support plate 528 is illustrative in nature only, and many other mechanisms/designs could be used to support a container in a coil spring.

Figure 11:
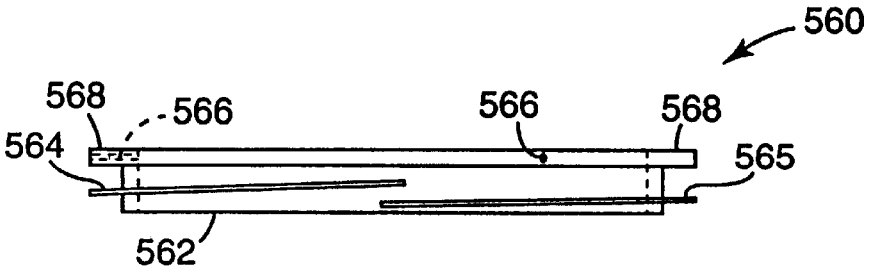
FIG. 11 is a side view of one illustrative embodiment of a support ring for use with a printing fluid supply container support system according to FIG. 6.
Figure 12:
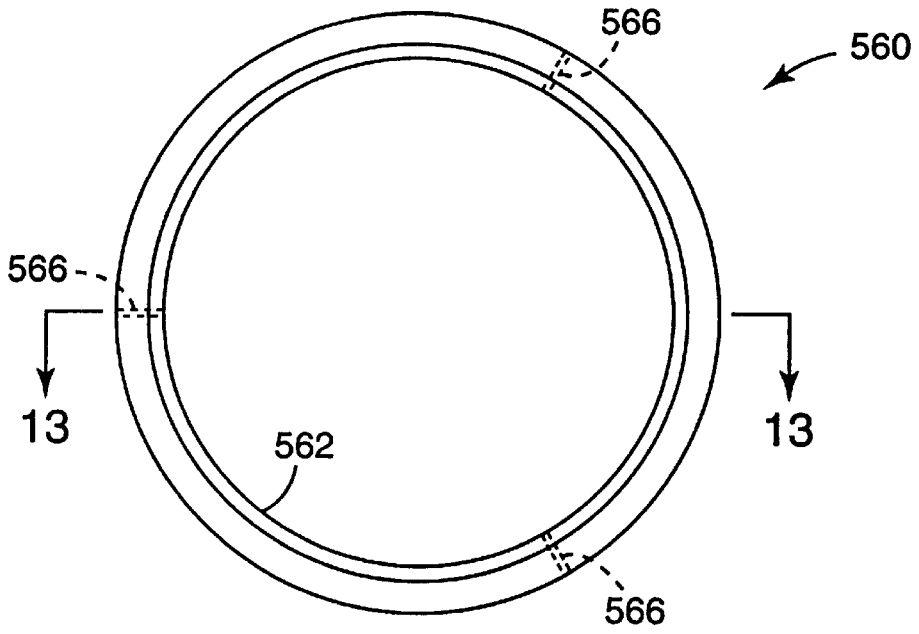
FIG. 12 is a top view of the support ring of FIG. 11.
Figure 13:
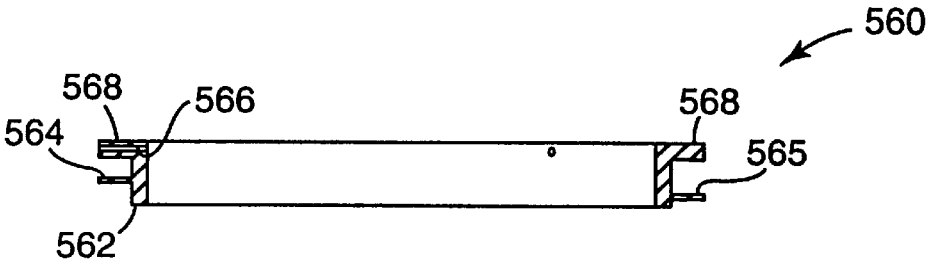
FIG. 13 is a cross-sectional view of the support ring of FIGS. 11 & 12, taken along line B—B.

FIGS. 11–13 depict one illustrative embodiment of a support ring 560 used to retain the upper end of spring in position, such as spring 530 in FIG. 6. The support ring 560 includes a portion 562 through which a container can be inserted (see FIG. 6). An upper flange 568 extends from portion 562 and includes a number of bored openings 566 adapted to receive a threaded fastener such as 540 discussed in conjunction with FIG. 7 above. In the illustrated embodiment, the openings 560 are located at 120° intervals about ring 560.

A pair of lower flanges 564 and 565 extend from portion 562 and are located below upper flange 568. The space between upper flange 568 and lower flanges 564 and 565 is adapted to received the upper end of a coil spring (see FIG. 6) to retain it in place relative to a housing. In the illustrated embodiment, lower flanges 564 and 565 are helical relative to upper flange 568 to assist in capturing an upper coil of a coil spring. It should be understood that the support ring 560 is illustrative in nature only, and many other mechanisms/designs could be used to support and retain a coil spring in a housing.

An additional feature which can be provided in any of the systems according to the present invention is the "keying" of the containers and their respective support mechanisms. By keying, it is meant that the container and its respective support system are provided with complementary shapes to prevent the use of, for example, ink with the wrong density in the system. The keying could take the form of indenting the bottom of the container and providing a complementary protrusion on the plate supporting the container or it could include shaping the container itself to fit within a complementary shaped housing, e.g., a hexagonal container in a hexagonal housing. In such a system, a variety of housings and complementary containers could be provided for each of the ink densities to be used with the printer or plotter.

Furthermore, although the springs and resilient members described above exhibit generally unchanging spring constants, it will be understood that with proper container shapes, the use of cams, etc., the present invention could also be used with springs exhibiting variable and/or non-linear spring constants.

The present invention has been described above with respect to illustrative embodiments to which modifications may be made without departing from the scope of the invention as defined by the appended claims.

What is claimed is:

1. A system for delivering printing fluid from a container to a printing mechanism, printing fluid in the container having a free surface defining a generally horizontal cross-section of the container, the system comprising (a) a resilient member supporting the container against the force of gravity, wherein the resilient member has a spring constant such that the vertical distance between the free surface of the printing fluid and the printing mechanism remains substantially constant as printing fluid is removed from the container, and (b) means for adjusting the spring constant acting on the container.

2. A system according to claim 1, wherein the container is shaped such that the area of the free surface of the printing fluid remains substantially constant as printing fluid is removed from the container.

3. A system according to claim 1, wherein the spring constant of the resilient member is substantially equal to the weight of the printing fluid per unit of depth in the container.

4. A system according to claim 1, wherein the resilient member comprises a coil spring.

5. A system according to claim 1, wherein the container is replaceable.

6. A system according to claim 1, wherein the resilient member comprises a coil spring, and further wherein the means for adjusting the spring constant comprises means for varying the number of coils of the coil spring acting to support the container.

7. A system according to claim 6, wherein the means for varying the number of coils comprises threading a support plate supporting the container into the coils of the coil spring.

8. A system according to claim 1, wherein the resilient member comprises a single coil spring, and further wherein the container fits substantially within the inner diameter of the coil spring.

9. A system according to claim 1, wherein the resilient member comprises a torsion spring.

10. A system according to claim 1, wherein the container is operatively connected to the resilient member such that the container rotates about an axis as printing fluid is removed from the container.

11. A system according to claim 1, further comprising means for damping movement of the container.

12. A system according to claim 1, wherein the container is refillable.

13. A system for delivering printing fluid from a container to a printing mechanism, printing fluid in the container having a free surface defining a generally horizontal cross-section of the container, the system comprising (a) a resilient member supporting the container against the force of gravity, wherein the resilient member has a spring constant such that the vertical distance between the free surface of the printing fluid and the printing mechanism remains substantially constant as printing fluid is removed from the container, further wherein the container is shaped such that the area of the free surface of the printing fluid remains substantially constant as printing fluid is removed from the container, and further wherein the spring constant of the resilient member is substantially equal to the weight of the printing fluid per unit of depth in the container, and means for adjusting the spring constant acting on the container.

14. A system according to claim 13, further comprising means for damping movement of the container caused by the resilient member.

15. A system according to claim 13, wherein the resilient member comprises a coil spring.

16. A system according to claim 13, wherein the resilient member comprises a single coil spring, and further wherein the container fits substantially within the inner diameter of the coil spring.

17. A system according to claim 13, wherein the resilient member comprises a coil spring, and further wherein the means for adjusting the spring constant comprises means for varying the number of coils of the coil spring acting to support the container.

18. A system according to claim 17, wherein the means for varying the number of coils comprises threading a support plate supporting the container into the coils of the coil spring.

19. A printing system comprising:

a) a printer having a printing mechanism;

b) a container for holding printing fluid;

c) a fluid path between the printing mechanism and the container;

d) a resilient member supporting the container against the force of gravity, wherein printing fluid in the container has a free surface defining a generally horizontal cross-section of the container, and further wherein the resilient member has a spring constant such that the vertical distance between the free surface of the printing fluid and the printing mechanism remains substantially constant as the container moves relative to the printing mechanism when printing fluid is removed from the container; and e) means for adjusting the spring constant acting on the container.

20. A printing system according to claim 19, further comprising means for damping movement of the container caused by the resilient member.

21. A printing system according to claim 19, wherein the resilient member comprises a single coil spring, and further wherein the container fits substantially within the inner diameter of the coil spring.

22. A printing system according to claim 19, wherein the container is shaped such that the area of the free surface of the printing fluid remains substantially constant as printing fluid is removed from the container.

23. A printing system according to claim 19, wherein the spring constant of the resilient member is substantially equal to the weight of printing fluid per unit of depth in the container.

24. A printing system according to claim 19, wherein the resilient member comprises a coil spring.

25. A printing system according to claim 19, wherein the resilient member comprises a coil spring, and further wherein the means for adjusting the spring constant comprises means for varying the number of coils of the coil spring acting to support the container.

26. A printing system according to claim 25, wherein the means for varying the number of coils comprises threading a support plate supporting the container into the coils of the coil spring.

27. A method of providing printing fluid to a printing mechanism, the method comprising the steps of:

a) providing a container for printing fluid, wherein when printing fluid is in the container, the printing fluid has a free surface defining a generally horizontal cross-section of the container;

b) placing the container in fluid communication with the printing mechanism;

c) supporting the container against the force of gravity such that the vertical distance between the free surface of the printing fluid and the printing mechanism remains substantially constant as printing fluid is removed from the container; and d) adjusting the spring constant acting on the container.

28. A method according to claim 27, further comprising a step of damping movement of the container caused by the resilient member.

29. A method according to claim 27, further comprising a step of maintaining the area of the free surface of printing fluid substantially constant as printing fluid is removed from the container.

30. A method according to claim 29, wherein the step of maintaining the area of the free surface of printing fluid comprises shaping the container with a uniform horizontal cross-sectional area.

31. A method according to claim 27, wherein the step of supporting the container further comprises supporting the container with a resilient member having a spring constant of a value to maintain the desired distance between the free surface of printing fluid and the printing mechanism.

32. A method according to claim 31, further comprising a step of providing a resilient member having a spring constant substantially equal to the weight of printing fluid per unit of depth in the container.

33. A method according to claim 31, wherein the step of supporting the container with a resilient member comprises supporting the container with a coil spring.

34. A method according to claim 33, further comprising a step of fitting the container substantially within the inner diameter of the coil spring.

35. A method according to claim 27, wherein the step of adjusting the spring constant comprises means for varying the number of coils of the coil spring acting to support the container.

36. A method according to claim 35, wherein the step of adjusting the spring constant comprises threading a support plate supporting the container into the coils of the coil spring, wherein the plate is rotated to vary the number of coils acting to support the container.

* * * * *